United States Patent [19]

Weisenburger

[11] Patent Number: 4,560,224

[45] Date of Patent: Dec. 24, 1985

[54] FLAT CABLE TERMINATION

[75] Inventor: Lawrence P. Weisenburger, Kernersville, N.C.

[73] Assignee: AMP Incorporated, Harrisburg, Pa.

[21] Appl. No.: 619,399

[22] Filed: Jun. 12, 1984

Related U.S. Application Data

[63] Continuation of Ser. No. 339,557, Jan. 15, 1982, abandoned.

[51] Int. Cl.[4] ..... H01R 11/20

[52] U.S. Cl. ..... 339/97 C; 339/276 R

[58] Field of Search ..... 339/97 C, 98, 276 R, 339/276 F, 276 T

[56] References Cited

U.S. PATENT DOCUMENTS

| | | | |
|---|---|---|---|
| 3,504,101 | 3/1970 | Muto | 174/94 |
| 3,553,347 | 1/1971 | Harding et al. | 339/97 |
| 3,594,704 | 7/1971 | Fischer | 339/97 |
| 3,851,945 | 12/1974 | Collier | 339/97 C |
| 3,924,917 | 12/1975 | Munshower | 339/97 C |
| 3,997,233 | 12/1976 | Evans | 339/97 C |
| 4,002,393 | 1/1977 | Merry et al. | 339/97 C |
| 4,263,474 | 4/1981 | Tennant | 339/97 C |

OTHER PUBLICATIONS

J. Mittleman, "Connecting Aluminium Wire Reliably", 12-8-69, Electronics, vol. 42, No. 25, pp. 94-98, New York.

*Primary Examiner*—Gil Weidenfeld
*Assistant Examiner*—Paula A. Austin
*Attorney, Agent, or Firm*—F. Brice Faller; Robert W. Pitts

[57] ABSTRACT

An electrical terminal for flat cable comprising first and second metal plate portions having a cable penetrating tab-like lance and a socket aligned with the lance, respectively, the socket having lips pushed out of the plane of the plate portion and converging towards their free ends to define a slot-form lance receiving mouth. During termination, the cable will be penetrated by the lance and a portion of the cable conductor will be drawn into the mouth by the lance and compressed between a face of the lance and one lip. A portion of the cable is deformed during termination, into an aperture provided in the first metal plate by lance formation and ribbon conductor material is displaced from between the face of the tab and one lip further into the socket.

1 Claim, 7 Drawing Figures

FLAT CABLE TERMINATION

This application is a continuation of application Ser. No. 339,557 now abandoned filed Jan. 15, 1982.

The invention relates to the termination of ribbon conductors and more particularly to the termination of flat cable having ribbon conductors sandwiched between layers of insulation.

In circumstances where space is restricted and where cable thickness should be kept to a minimum, for example under carpets, it is often desirable to use flat cable. There have been many prior proposals for terminating such cable but none has been wholly satisfactory.

It one prior proposal described in U.S. Pat. No. 4,263,474, a terminal comprises a first metal plate portion from which upstands a cable penetrating tab-like lance and a second metal plate portion provided with a socket aligned with the lance and having lips pushed out of the plane of the plate and converging towards their free ends to define a circular lance receiving mount. Although pressing the plate portions together drives the lance through a cable located between the plates into the socket, the major current carrying connection is made between contact rings upstanding from respective plate portions which are clamped against opposite sides of the cable.

A disadvantage of the prior terminal is that the force required to obtain a satisfactory electrical connection between the contact rings and the cable conductor is relatively high and there may be a risk of relaxation of the connection in view of the small area of contact between the tab-like lance and the socket lip.

It is an object of the invention to provide an electrical terminal which will establish a reliable electrical connection to the ribbon conductors of a flat cable.

It is preferred that the terminal can be applied with simple tooling and without need for a high force. It is further preferred that the resulting terminations will have a relatively high current carrying capacity.

According to one aspect of the invention, there is provided an electrical terminal comprising a first metal plate portion from which upstands a cable penetrating tab-like lance having parallel opposite edge portions, a second metal plate portion provided with a socket aligned with the lance and having lips pushed out of the plane of the plate portion and converging towards their free ends to define a slot-form lance receiving mouth, the arrangement being such that, after penetration of the cable by the lance, a portion of the cable conductor will be drawn into the mouth by the lance and compressed between a face of the lance and one lip during entry of the lance into the socket.

In the resulting termination, the conductor portion is compressed between two metal parts for a distance equal to the entire width of the tab ensuring a good electrical connection. Each interface of the connection is metal to metal resulting in a gas tight connection.

Preferably, in a terminal according to the invention, the lance has been pushed out from the first metal plate portion providing an aperture into which a portion of the cable is deformed during termination, the face of the lance engaged by the conductor portion being adjacent the aperture.

Any tendency for the tab to relax would enhance the contact force.

According to another aspect of the invention, there is provided an electrical connection between a ribbon conductor and first and second metal plate portions of an electrical terminal in which a tab-like lance having parallel opposite edge portions upstanding from the first metal plate portion penetrates the ribbon conductor and is received in a socket provided in the second plate portion, the socket having lips pushed out of the plane of the second plate portion and converging towards their free ends to define a slot-form lance-receiving mouth, a portion of the conductor having been drawn into the mouth by the face of the lance and compressed between one lip and the face of the lance.

It is preferred that ribbon conductor material has been displaced from between the face of the tab and the one lip further into the socket.

In another prior proposal described in U.S. Pat. No. 3,247,316, a terminal for very thin foil-like conductors includes opposed metal plate portions each formed with raised teeth which engage the conductor where the plate portions are urged together. However, a disadvantage of the known connector is that all of the teeth must pierce and tear the conductor during termination to effect connection with the result that not only is a relatively high termination force required but the conductor is substantially weakened by the piercing and tearing. It would not be practicable to use the known connector to terminate flat cable in which the ribbon conductor is relatively thick in view of the high force required.

In a further prior proposal described in U.S. Pat. No. 3,997,233, although, a tab-form lance on one connector plate portion is received in a slot or another plate portion after penetration of a ribbon conductor, a portion of ribbon conductor drawn into the slot is not compressed between two metal parts, insulation being trapped between a lip of the slot and the ribbon conductor with a consequential risk of relaxation of the connection and loss of satisfactory electrical connection.

A specific example of the invention will now be described with reference to the accompanying drawings in which.

Figure 1:
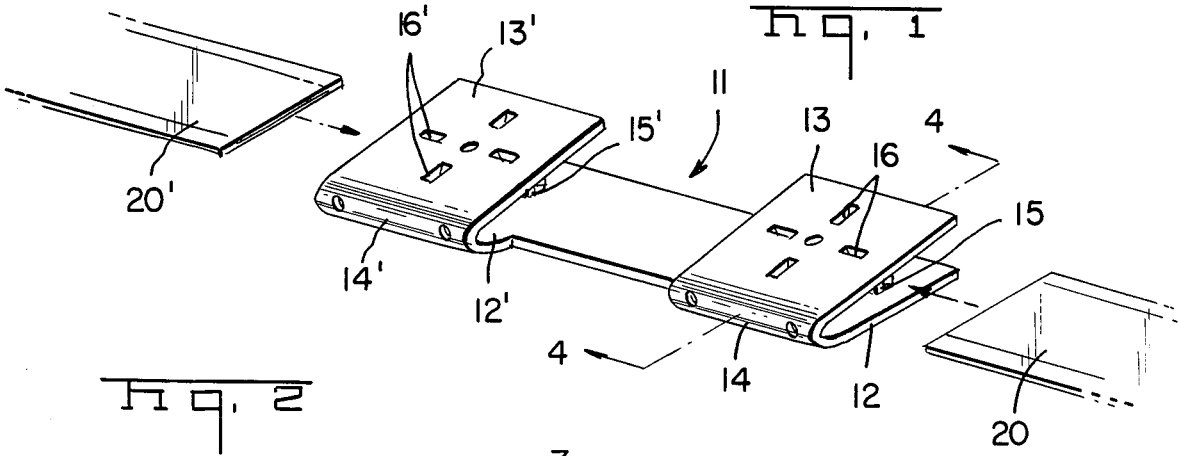
FIG. 1 is a perspective view of a terminal according to the invention with flat cable ends aligned for insertion therein.
Figure 2:
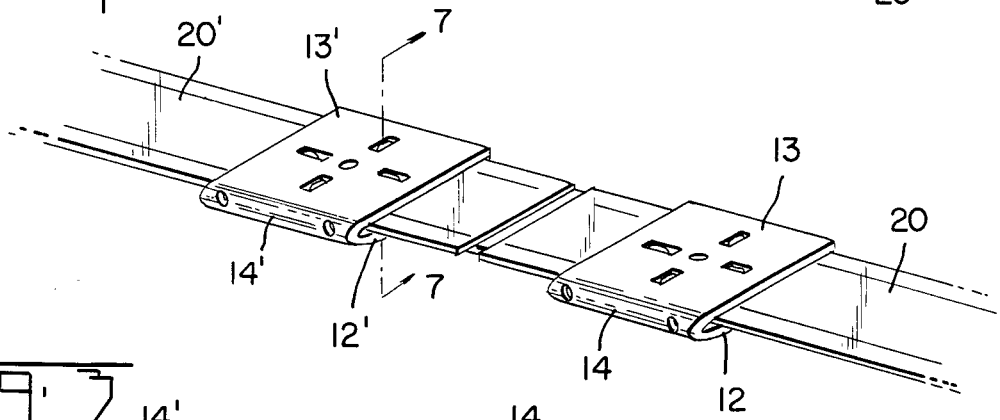
FIG. 2 is a perspective view of the terminal of FIG. 1 after termination of the cable.
Figure 3:
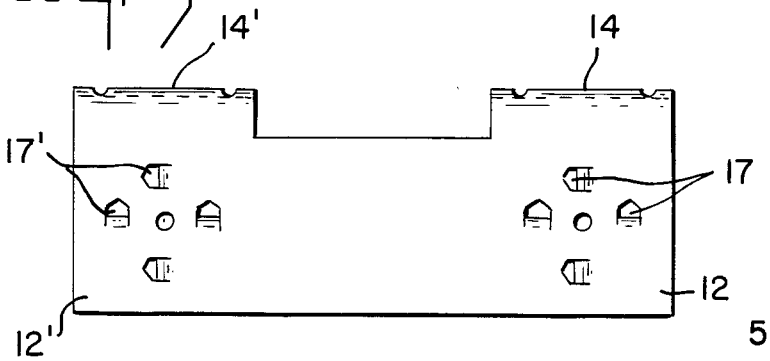
FIG. 3 is an underplan view of the terminal of FIG. 1.
Figure 4:
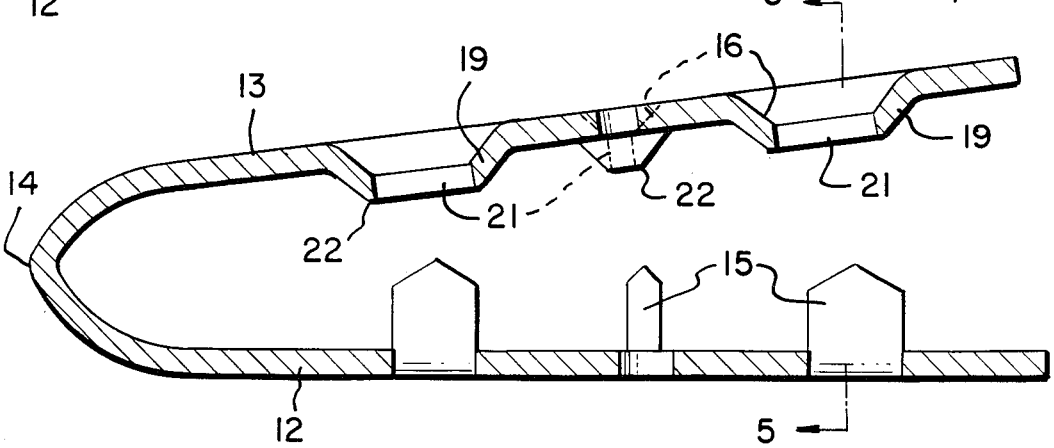
FIG. 4 is a cross-sectional view taken along line 4—4 of FIG. 1.

The splice terminal 11 is stamped and formed from a single piece of sheet metal stock, (approximately 0.016 inches thick Cu alloy 195), and comprises first and second plate portions 12,12' and 13,13' at respective opposite ends for terminating respective ends of flat cable 20,20'. Each first plate portion 12 or 12' is integrally joined to its respective second plate portion 13 or 13' by an integral web 14 or 14'.

A series of tab-form lances 15 and 15∝ having parallel opposite edge portions are located in cruciform fashion on respective first plate portions in alignment with a corresponding series of sockets 16 and 16' located on the respective second plate portions. Each lance 15 or 15′ is pushed out of the plane of the plate portion providing an aperture 17 or 17′. Each socket 16 or 16′ has lips 19 pushed out of the plane of the plate portion and converging towards their free ends to define a slot-form lance receiving mouth 21. The edges 22 of the lips 19 are relatively sharp being defined by piercing through impressed portions of the plate to provide the mouth.

The flat cables comprise ribbon conductors 23 of 0.009 to 0.014 inches thick sandwiched between first and second layers of insulation 24 and 25 (MYLAR) approximately 0.007 inches thick and a proprietary adhesive.

Figure 7:
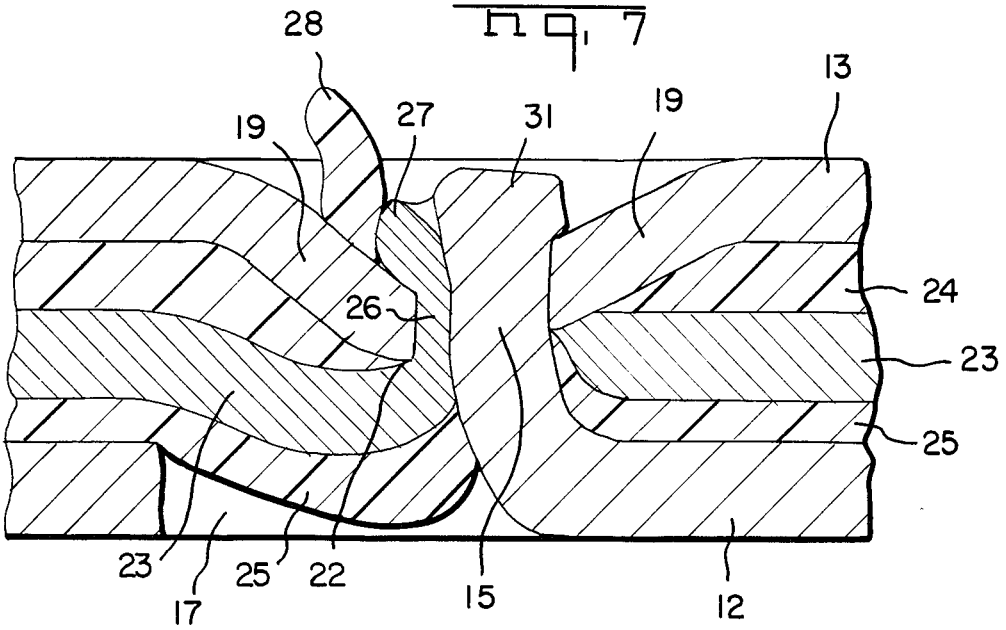
Figure 5:
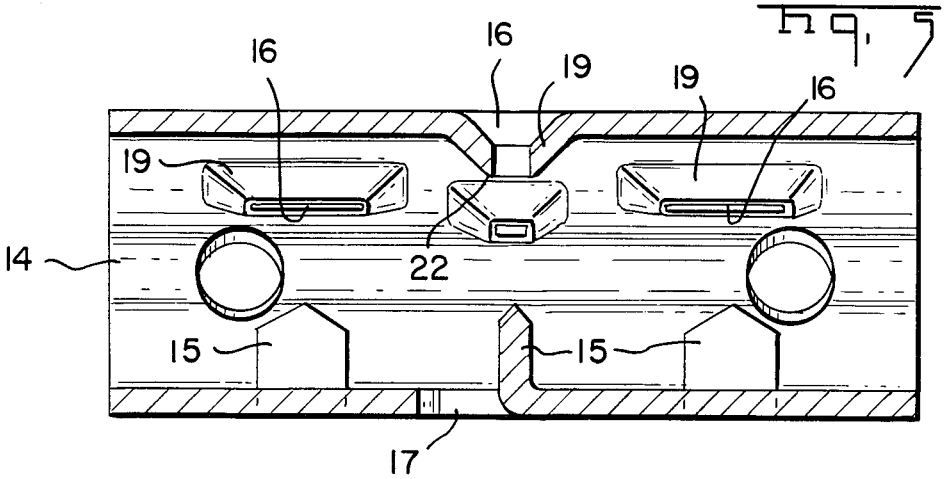
FIG. 5 is a cross-sectional view taken along 5—5 of FIG. 4.
Figure 6:
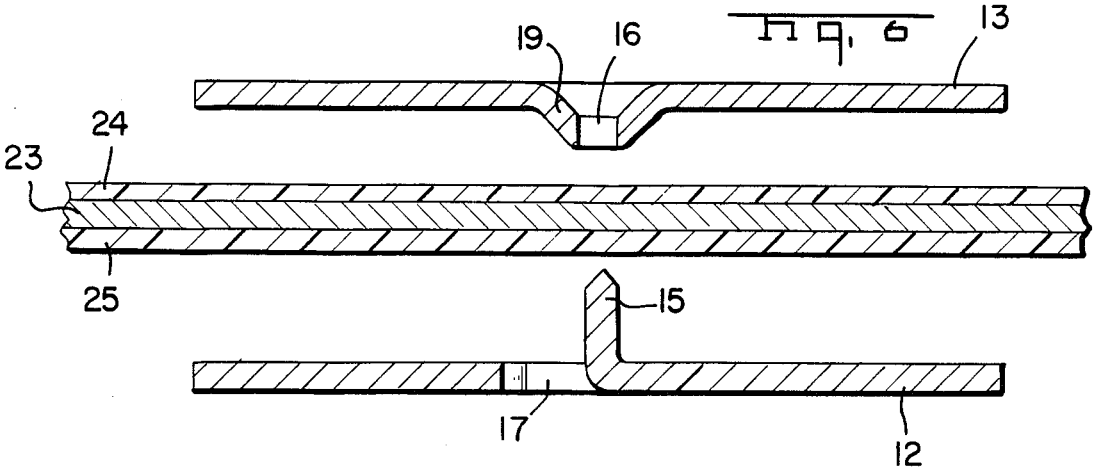
FIG. 6 is a schematic cross-sectional view with the cable inserted therein prior to termination; and, FIG. 7 is a fragmentary cross-sectional view of the termination taken along line 7—7 of FIG. 2.

In use of the terminal, a cable is inserted between first and second plate portions 12 and 13 and a plier type tool having planar pressing faces is used to apply a force of approximately 1,000 pounds to the plate portions forcing the lances through the cable into the mouths drawing with them portions 27 of the ribbon conductor. During entry into the mouth a portion 28 of the insulation is severed by the edge 22 of the lip 19 and ultimately expelled from between the conductor and lip. Conductor material is displaced from between the faces of the tabs and the lips 19 leaving portions 26 of reduced thickness compressed between the face of the tabs and the lips. As seen in FIG. 7, the conductor 26 is compressed between only one face of the tab form lance 15 and only the one lip 19 adjacent that face of lance 15. Portions of ribbon conductor and the other layer 25 of insulation are deformed into the respective apertures 17. Forces acting on the free end 31 of the lance during termination broaden the free end assisting in preventing relaxation of the connection and are transmitted through the lance to the portion 26 of the conductor enhancing the compressive force.

It should be noted that, in the termination, a major component of the forces acting on the conductor portion 26 extend in the plane of the terminal. As both interfaces of the connection to the conductor are metal to metal the connection is gas tight and less prone to relax than if an insulating layer were under compression at one interface. Both the lance and the conductor portion 26 are gripped between and in direct metal-to-metal contact with the opposite metal lips 19 which are also under compression having been deformed back towards the plane of the plate portion by the force applied during termination.

The resulting termination is capable of carrying relatively high currents of up to 60 amps and yet the termination is of relatively low height. In consequence, the termination is particularly suitable for undercarpet flat cable.

What is claimed is:

1. An electrical connection between a ribbon conductor and first and second metal plate portions of an electrical terminal in which a tab-like lance having parallel opposite edge portions upstanding from the first metal plate portion penetrates the ribbon conductor and is received in a socket provided in the second plate portion, the socket being defined by opposed lips pushed out of the plane of the second plate portion, the lips converging towards their free ends to define a slot-form lance-receiving mouth, a portion of the conductor having been drawn into the mouth by the lance and compressed between one lip only and one face only of the lance, the other face of the lance engaging the other opposed lip.

* * * * *